US008066130B2

(12) United States Patent
Shaha et al.

(10) Patent No.: US 8,066,130 B2
(45) Date of Patent: Nov. 29, 2011

(54) STORAGE SYSTEM

(75) Inventors: Kevin Bruce Shaha, Dover, ID (US); Robert W. Sheldon, Winnetka, IL (US); Gregory J. Foster, Chicago, IL (US); Ronald M. Llanes, Lisle, IL (US)

(73) Assignee: Illinois Tool Works Inc., Glenview, IL (US)

( * ) Notice: Subject to any disclaimer, the term of this patent is extended or adjusted under 35 U.S.C. 154(b) by 377 days.

(21) Appl. No.: 12/049,090

(22) Filed: Mar. 14, 2008

(65) Prior Publication Data

US 2009/0230067 A1 Sep. 17, 2009

(51) Int. Cl.
*A47F 5/08* (2006.01)

(52) U.S. Cl. ..... 211/90.01; 211/94.01; 211/106.01

(58) Field of Classification Search ..... 211/183, 211/94.01, 106.01, 57.1, 87.01, 162, 90.01, 211/90.02, 90.04; 248/303, 304
See application file for complete search history.

(56) References Cited

U.S. PATENT DOCUMENTS

| | | | | | |
|---|---|---|---|---|---|
| 221,809 | A | * | 11/1879 | Greig | 402/68 |
| 4,189,123 | A | * | 2/1980 | Johnson | 248/222.51 |
| 4,311,295 | A | * | 1/1982 | Jamar, Jr. | 248/222.11 |
| 4,618,192 | A | * | 10/1986 | Kelley | 312/245 |
| 4,693,381 | A | | 9/1987 | Lodge | |
| 4,817,900 | A | * | 4/1989 | Whittington et al. | 248/223.41 |
| 4,869,378 | A | | 9/1989 | Miller | |
| 4,942,498 | A | * | 7/1990 | Toussaint | 361/709 |
| 5,048,698 | A | | 9/1991 | Konrad | |
| 5,125,518 | A | * | 6/1992 | Ward | 211/87.01 |
| 5,337,987 | A | | 8/1994 | Sawatsky | |
| 5,379,976 | A | * | 1/1995 | DeGirolamo | 248/220.43 |
| 5,429,252 | A | | 7/1995 | Liu | |

(Continued)

FOREIGN PATENT DOCUMENTS

FR 2 580 214 10/1986

OTHER PUBLICATIONS

International Searching Authority, PCT Notification of Transmittal of The International Search Report and The Written Opinion of the International Searching Authority, or the Declaration, PCT/US2008/073652, European Patent Office (ISA) Mailing Date Dec. 18, 2008, 12 pages.

*Primary Examiner* — Korie Chan
(74) *Attorney, Agent, or Firm* — Mark W. Croll; Patricia M. Chidiac; Beem Patent Law Firm

(57) ABSTRACT

In one aspect, a storage system includes a base comprising a bottom channel, a top channel and a protrusion therebetween, at least one arm having an upturned tab and a rearwardly extending tab, wherein the upturned tab is configured to engage the top channel and the rearwardly extending tab is configured to engage a bottom surface of the protrusion and further wherein the bottom channel is adapted to receive a second arm under the first arm. In another aspect, a storage system may be mountable to a friable substrate and include a base having a plurality of holes for accepting a plurality of drywall fasteners; a plurality of self-drilling drywall fasteners having a crest diameter of at least about ¼ inch; a plurality of arms operatively connected to said base; a shelf; and at least one hook or bin operatively connected to the base at the lower channel.

19 Claims, 10 Drawing Sheets

U.S. PATENT DOCUMENTS 5,775,521 A * 7/1998 Tisbo ..... 211/94.01
5,960,967 A 10/1999 Neil
6,050,426 A 4/2000 Leurdijk
6,119,878 A 9/2000 Zen
6,152,312 A 11/2000 Nava et al.
6,286,802 B1 * 9/2001 Munson et al. ..... 248/475.1
6,299,001 B1 10/2001 Frolov et al.
6,499,608 B1 12/2002 Sterling et al.
6,698,603 B2 3/2004 Lawson et al.
7,014,052 B2 3/2006 Dettorre et al.
7,137,515 B1 11/2006 Lawson et al.
7,147,115 B2 12/2006 Perkins et al.
7,228,977 B2 6/2007 Perkins et al.
7,686,172 B2 * 3/2010 Wisnoski et al. ..... 211/94.01
7,686,265 B2 * 3/2010 Hall ..... 248/222.11
2004/0169116 A1 * 9/2004 Nogare et al. ..... 248/273
2005/0236544 A1 10/2005 Mancino et al.
2005/0247653 A1 11/2005 Brooks
2006/0180561 A1 8/2006 Wisnoski et al.
2008/0047911 A1 * 2/2008 Kao ..... 211/70.6
2009/0230267 A1 * 9/2009 Ernst et al. ..... 248/231.9

* cited by examiner

D
DC
DH
C
6
L2
RD21
TP2
RD22
RD23
E
TC21
MC22
MC21
810
812
814
815
816
818
819
820
821
822
823
826
827
828
829
830
831
854
864

STORAGE SYSTEM

BACKGROUND OF THE INVENTION

1. Field of the Invention

The present invention is directed to a storage system, mountable on a friable substrate such as drywall, for holding or organizing an object or plurality of objects such as household or garden items, e.g., tools, hoses, ladders, etc.

2. Description of the Related Art

Wall mounted storage systems have traditionally come in two main types, those that employ pegboard or those that use variations of a slot-wall. Peg board storage systems suffer from only allowing a user to install hooks at predetermined locations in the wall, i.e., wherever a peg is located. In addition, hooks inserted into peg board may be easily dislodged by upward movement, for example, when removing an object placed on the hook.

Slot-wall systems may address the upward movement problem of peg board in two ways. Either the hook has a portion that is generally the same size as the interior of the slot to create a tighter fit, or else it requires the hook interface with two slots to restrict its movement. Slot wall systems, while allowing for lateral movement, generally require at least one open side in order to insert hooks or other attachments.

Slot-wall systems, and particularly peg board systems are usually large systems, occupying several square feet of wall space. These systems are typically time intensive to install as holes need to be drilled and measure to ensure the systems are installed level, and a significant number of screws are generally used to affix the systems to the wall.

What is needed is a storage system mountable to a friable substrate that may be easily installed at any number of locations chosen by a user, whereby the storage system has increased pullout resistance and load capacity in the friable substrate.

BRIEF SUMMARY OF THE INVENTION

In one aspect of the invention, a storage system may have a base comprising a bottom channel, a top channel spaced from the bottom channel and a protrusion therebetween. The system may further include at least one arm having an upturned tab and a rearwardly extending tab, wherein the upturned tab is configured to engage the top channel and the rearwardly extending tab is configured to engage a bottom surface of the protrusion at a desired location along the length of the base, wherein the bottom channel is adapted to receive a second arm at the desired location along the length. The top channel may have a downturned portion, which may have a rearward facing surface, and the upturned tab may operatively engage the rearward facing surface. The bottom surface may have an indentation and the rearwardly extending tab may have a dimple that operatively engages the indentation. The upturned tab may have a height substantially similar to a height of the top channel. The system may further have at least one hook or at least one bin operatively coupled to the bottom channel. In addition the hook or bin may have at least one mounting plate having at least one generally downward facing hook and at least one generally upward facing hook such that the generally downward facing hook may operatively connect to the bottom channel and the generally upward facing hook may operatively connects to a bottom of the base.

In another aspect, a storage system mountable to a friable substrate may include a base having a plurality of holes for accepting a plurality of drywall fasteners, a lower channel, a protrusion extending outward from a rear surface of the base and proximate the lower channel, and a secondary channel proximate the protrusion; a plurality of self-drilling drywall fasteners having a crest diameter of at least about ¼ inch; a plurality of arms operatively engaged with the base at the lower channel, the protrusion and the secondary channel; a shelf operatively connected to the plurality of arms and the base; and at least one hook or bin operatively engaged with the base at the lower channel. The storage system may also be modular, having a connection for attaching the base to a second base and may have at least one end cap for concealing the connection. The protrusion may be angled with respect to the base, and the plurality of arms may have a rear surface having a substantially similar angle for operative connection with the protrusion. In addition, the protrusion may have a bottom surface with an indentation and at least one of the arms may have a dimple for operatively engaging the indentation. Moreover, the hook or bin may have a generally downward facing hook and a generally upward facing hook, the base may have a bottom, the lower channel may have a forward side having an upper part, the generally downward facing hook may operatively engage the upper part and the generally upward facing hook may operatively engages the bottom.

These and other features and advantages are evident from the following description of the present invention, with reference to the accompanying drawings.

DETAILED DESCRIPTION

Figure 1:
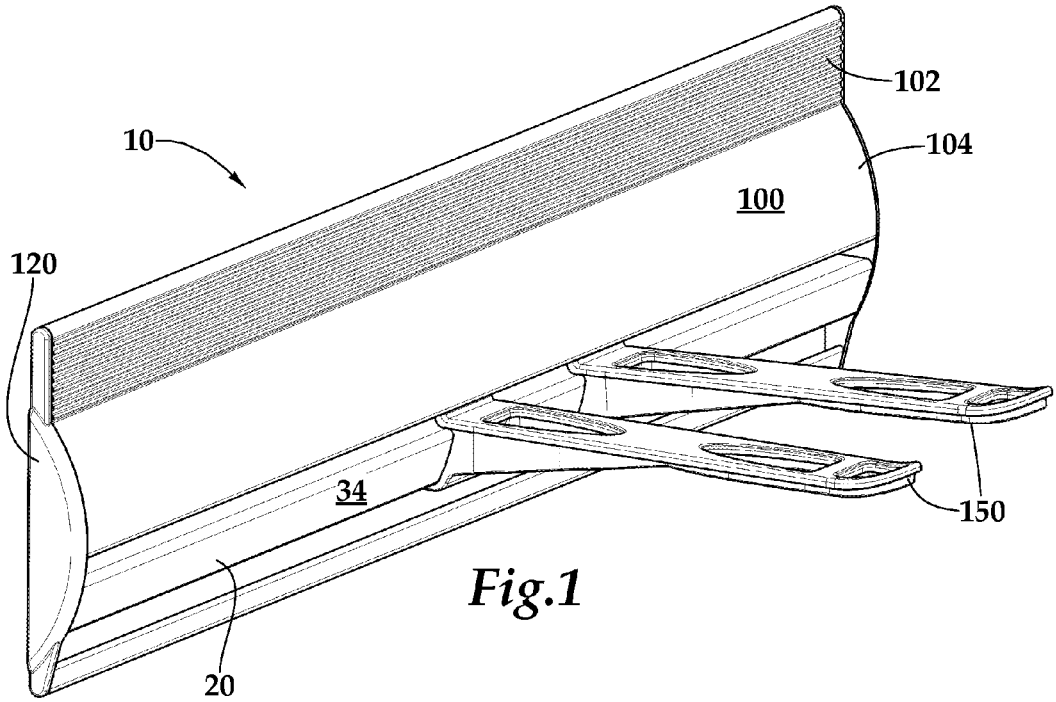
FIG. 1 is a perspective view of one embodiment of a storage system mountable to a friable substrate.
Figure 2:
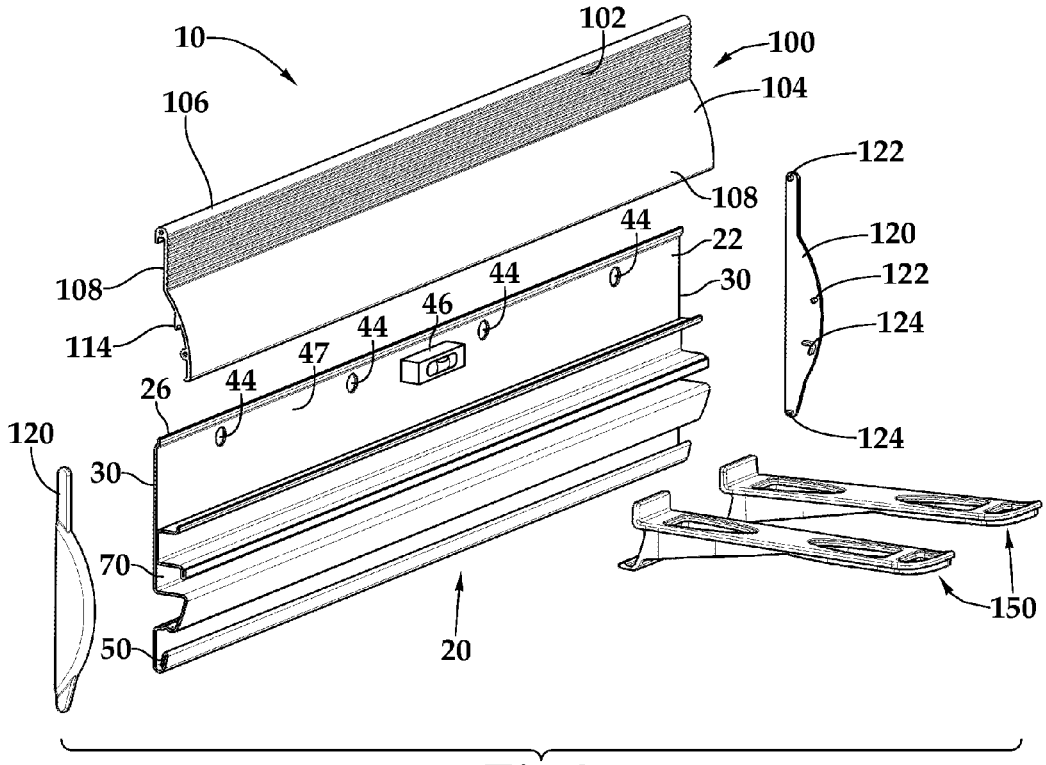
FIG. 2 is an exploded view of the system of FIG. 1.
Figure 3:
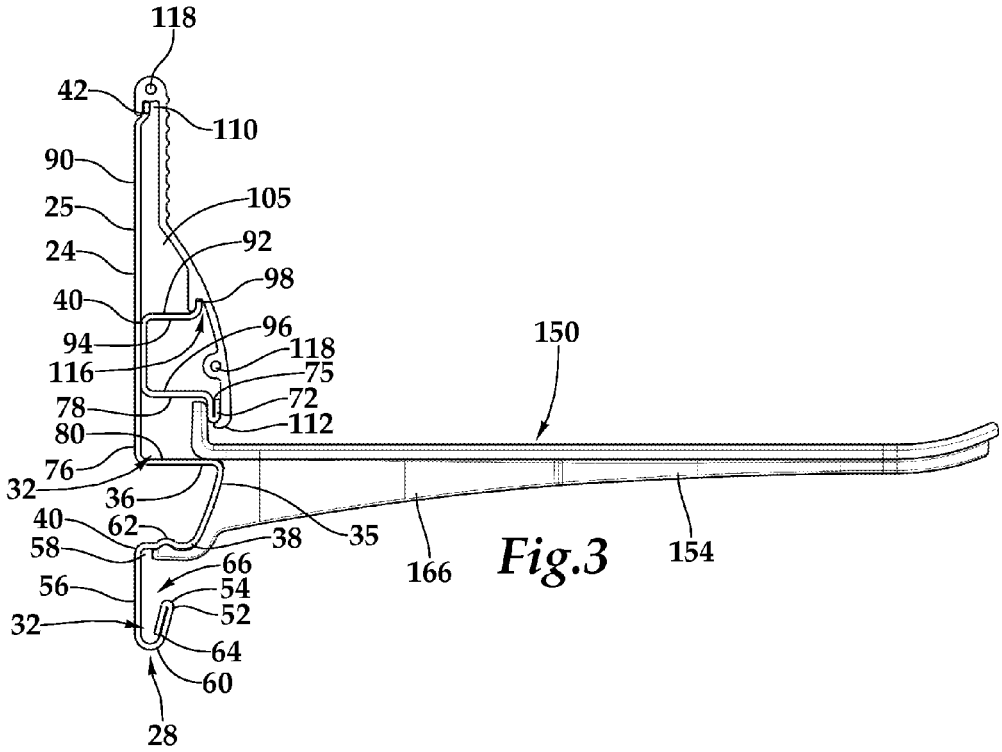
FIG. 3 is a side view of the system of FIG. 1 with endcap removed.
Figure 20:
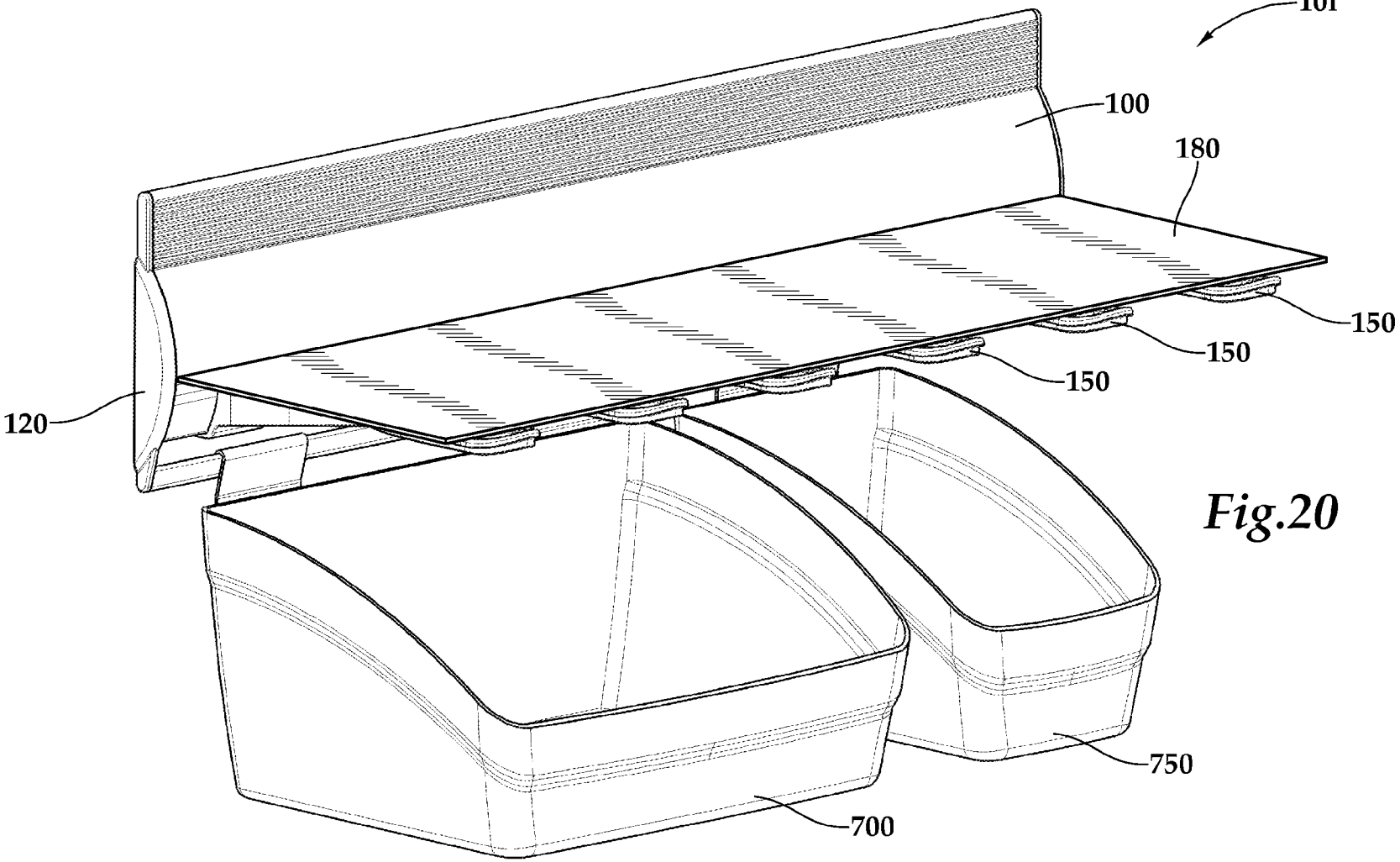
FIG. 20 is a perspective view of another embodiment of a storage system mountable to a friable substrate.
Figures 21, 22, 23, 24, 25:
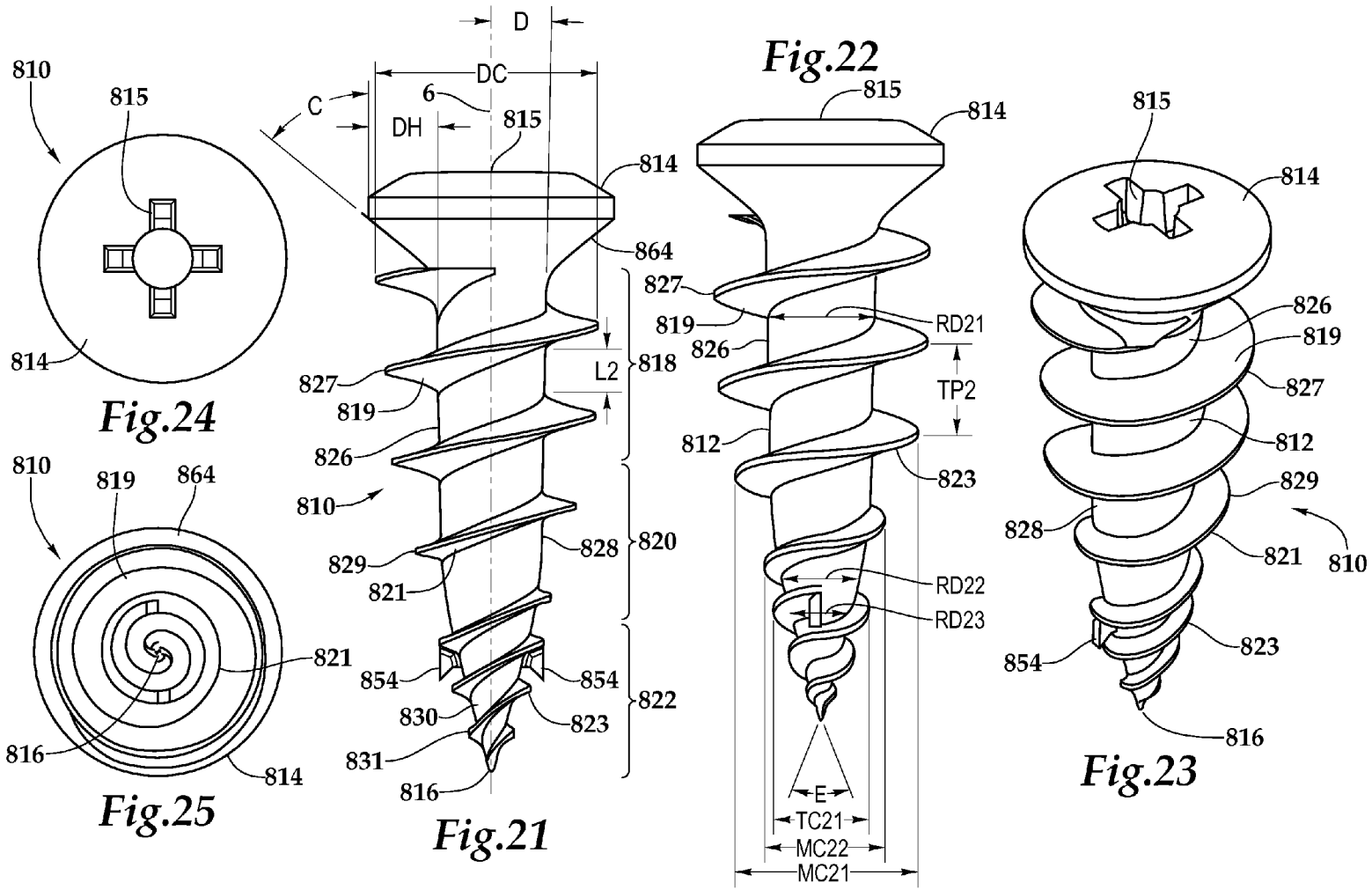
FIG. 21 is a side view of a self-drilling drywall fastener for use with the storage system.
FIG. 22 is a side view of the self-drilling drywall fastener of FIG. 21, rotated 90° from the view of FIG. 21.
FIG. 23 is a perspective view of the self-drilling drywall fastener of FIG. 21.
FIG. 24 is a top view of the self-drilling drywall fastener of FIG. 21.
FIG. 25 is a bottom view of the self-drilling drywall fastener of FIG. 21.

Storage system 10 is mountable to a friable substrate such as drywall and is used for holding, typically hanging, an object (not shown), such as a tool, a ladder, a broom, a spade, a bicycle, or other objects on a friable substrate such as drywall. Referring to FIGS. 1-3, a storage system 10 may include base 20 comprising bottom channel 50, top channel 70 spaced from bottom channel 50 and protrusion 34 therebetween, at least one arm 150 having upturned tab 168 and rearwardly extending tab 172, wherein upturned tab 168 may be is configured to engage top channel 70 and rearwardly extending tab 172 may be configured to engage bottom surface 38 of protrusion 34. As seen in the embodiments of FIGS. 15-19, bottom channel 50 may be adapted to receive hooks or second arm 200, and as seen in the embodiment of FIG. 20, system may include a shelf 180 and may be adapted to receive one or more bins 700, 750.

Base

Returning to FIGS. 1-3, a storage system 10 may include a base 20 having a front surface 22, a rear surface 24, a top or upper edge 26, a bottom 28 and sides 30. Front surface 22 may comprise a plurality of tracks, grooves or channels 50, 70. In one embodiment, front surface may comprise two generally parallel channels 50, 70. Front surface 22 may further comprise at least one protrusion 34 between channels 50, 70. Channels 50, 70 and/or protrusion 34 may extend substantially along the length of base 20. In addition, channels 50, 70 may be shaped differently, as described below in greater detail.

A first, or bottom channel 50, may be proximate bottom 28 of base 20. Bottom channel 50 may have surface for allowing hooks 200 to interface with channel 50 such as an indentation 64 at the bottom 60 of channel 50. Channel 50 may support hooks and assist in preventing vertical motion or motion in a direction other than generally along a length of channel 50.

As seen in FIG. 3, bottom channel 50 may have a forward side 52 through which hooks 200 may pass in order to install hooks 200. Forward side 52 may have an upper part 54 over which a portion of hooks 200 may pass to allow admittance into bottom channel 50. Forward side 52 may be shorter than rearward side 56, thereby creating an entrance 66 into bottom channel 50. Entrance 66 may be sized so as to allow installation of hooks 200 but also to restrict movement of hooks 200 once installed. In one embodiment, entrance may be between about ¼ and about ¾ the length of rearward side 56 or between about ⅓ and about 3 times longer than forward side 52, preferably about ½ the length of rearward side 56 or about generally equal to the length of forward side 52.

Continuing with FIG. 3, forward side 52 may be thickened as compared to a thickness of rearward side 56, top 58 of bottom channel 50 or bottom 60 of bottom channel 50 to provide additional support for hooks 200 or loads suspended from hooks 200. Forward side 52 may be between about 1 and about 5 times thicker than other parts of bottom channel 50, preferably between about 2 and about 4 times thicker, still more preferably between about 2 and about 3 times thicker, and in one embodiment, about 2 times thicker than other parts of bottom channel 50. Forward side 52 may also be inclined in comparison to mounting surface 8. Incline may increase the contact surface area between forward side 52 and hooks 200, increasing holding strength and creating greater stability for system 10. Incline may also make it more difficult for hooks to become dislodged when a load is applied to or removed from hook 200 because hook 200 may rotate about the incline, causing upper portion 200 of hook 200 to contact rearward side 56 of bottom channel 50, thereby restricting movement of hook 200. Incline may be between 0 degrees and about 45 degrees, preferably between about 5 degrees and about 30 degrees, more preferably between about 10 degrees and about 20 degrees, and in one embodiment, about 15 degrees.

Bottom channel 50 may be formed generally adjacent to mounting surface 8 to increase the shear component of the force exerted by an object suspended from hook 200 and, thereby, reduce the bending moment exerted by the object on the storage system 10 and on fasteners 12 holding storage system 10 to mounting surface 8. This may be accomplished through one or more structural considerations that decrease the distance between mounting surface 8 and rearward side 56 of bottom channel 50 and/or decrease the distance between mounting surface 8 and forward side 52 of bottom channel 50. For example, base 20 may be formed such that rear surface 24 of base 20 comprises rearward side 56 of bottom channel 50. In addition, rear surface 24 may be generally flush with mounting surface 8. Moreover, forward side 52 of bottom channel 50 may be spaced a predetermined distance from rearward side 56 of bottom channel 50. Predetermined distance may be approximately the thickness of generally downward facing hook 212 of hook 200 to create an interfacing fit between hook 200 and bottom channel 50, or predetermined distance may be selected to be larger than generally downward facing hook 212 of hook 200.

Base 20 may further comprise a protrusion 34 extending outwardly from base 20 and spaced from bottom channel 50. Protrusion 34 may be spaced from bottom channel, but, as seen in FIGS. 2 and 3, protrusion 34 may be proximate bottom channel 50, such that bottom 38 of protrusion 34 may comprise top 58 of bottom channel 50. Front 35 of protrusion 34 may be angled with respect to mounting surface 8. Angle may be within the ranges stated above for forward side 52 of bottom channel 50. In one embodiment, front 35 may be angled substantially equal to or slightly more than forward side 52 of bottom channel 50. In addition, front 35 of protrusion 34 may extend outward from mounting surface farther than forward side 52 of bottom channel 50 so as to allow for easier insertion of hooks 200 into bottom channel 50, as well as to provide structure for inhibiting dislodgement of hooks 200 in a vertical direction. In one embodiment, top 36 of protrusion 34 extends about twice as far as upper part 54 of forward side 52 of bottom channel 50.

Protrusion 34 may further have a longitudinally extending rigid material 39 operatively connected to front 35 and top 36 of protrusion 34. In this way, protrusion 34 may be less prone to bending or other deformation at the intersection of front 35 and top 36.

Top 36 and bottom 38 of protrusion 34 may be generally perpendicular to mounting surface, and height of protrusion may be generally equal to depth of top 36 of protrusion. However, as described in greater detail below, bottom 38 may have means for interfacing with arm attachments 150.

Base 20 may further comprise a secondary or top channel 70 spaced from protrusion 34. However, as seen in FIGS. 2 and 3, secondary channel 70 may be proximate protrusion 34. In one embodiment, top 36 of protrusion may comprise bottom 80 of secondary channel 70. Secondary channel 70 may be generally rectangular in shape and may have a depth extending from rear surface 24 greater than its height, although the depth and height may be substantially similar.

Staying with FIG. 3, secondary channel 70 may have a rearward facing downturned portion 75 from top 78 of second channel 70 at a forward side 72 that extends a portion of the height of secondary channel 70 so as to allow insertion of arm attachments 150. Downturned portion 75 may extend between about ¼ and about ¾ the height of secondary channel, preferably between about ⅓ and about ½ the height. In addition, downturned portion 75 may have a thickness greater than top 78, bottom 80 or rearward side 76 of secondary channel 70. Extra thickness may provide additional strength to resist forces applied by arm attachments 150, as well as creating a mating surface for cover 100. In one embodiment, downturned portion 75 may be about twice as thick.

Base 20 may be comprised of a thin, relatively strong material to withstand repeated loading and unloading of hooks 200, arm attachments 150 and loads supported by hooks 200 or arm attachments 150. Base 20 may be made of steel, plastic, or one or more other suitable materials. In one embodiment, base 20 is made of rolled steel and may be of unitary construction. In another embodiment, base 20 is made of a plurality of pieces 90, 92 of rolled steel operatively connected to one another, such as by welding, riveting or through other means. Second piece 92 of base 20 may be generally parallel to first piece 90. Second piece 92 may have an upper portion 94 that may extend substantially along a length of base 20. Upper portion 94 may also have an upturned lip 98 for engagement with cover 100. In addition, bottom 96 of second piece 92 may comprise top 78 of secondary channel 70. System may be between about 12 inches and about 36 inches, preferably between about 14 inches and about 30 inches, still more preferably between about 16 inches and about 24 inches.

Turns in steel may have radii of curvature 40 so as to prevent the formation of stress concentrations or other areas of weakness. In one embodiment, radii of curvature 40 are generally similar throughout turns of base 20.

As can be seen in FIGS. 2 and 3, rear surface 24 of base 20 may have a plurality of generally planar surfaces 25 such that base may lay generally flush against mounting surface (not shown) when installed in order to minimize distance base 20 extends from mounting surface and to increase shear component of loading, thereby increasing system 10 holding strength.

In the embodiment shown in FIGS. 2 and 3, generally planar surface 25 extends to an upper edge 26. Upper edge 26 may have means for attaching a cover 100 such as outwardly extending lip 42. Generally planar surface 25 of base 20 may have a plurality of holes 44 for admitting a plurality of drywall fasteners having a crest diameter of at least about ¼ inch, preferably at least about ½ inch. Fasteners may resemble those disclosed in the commonly assigned patent application Ser. No. 11/850, 70,311 to Ernst, et al., the contents of which are incorporated by reference herein, so that fasteners may be used to install system without regard for the location of support members behind mounting surface 8.

Each drywall fastener may include a head having a recess, such as a Phillips recess, for receiving a rotary driver so that system may be installed with a driving tool, such as a screwdriver or a drill with a screwdriver bit. Recess includes one or more torque transmitting surfaces so that torque may be transmitted from the rotary driver to rotate drywall fastener in order to drive drywall fastener through the drywall.

Holes 44 may be sized slightly larger than major diameter of fasteners so as to allow free passage of fasteners during installation. In contrast, holes 44 may be sized slightly smaller than major diameter of fasteners so as to meter fastener during installation. In addition, holes 44 may be sized smaller than heads of fasteners so that each head engages the base 20 around the hole 44. Holes 44 may have generally collinear centers to install fasteners along a common line. However, holes 44 may be vertically offset from one another, staggered, or in any other configuration. Holes 44 may be spaced equidistantly, for example, about every 6 inches. Outermost holes may be spaced about half the distance between holes 44 from sides 30 of base, i.e., about 3 inches in the example above. It is contemplated that system 10 installed using fasteners as described above may have a holding strength of at least about 50 lbs in drywall.

As seen in FIG. 2, base 20 may further comprise a level 46, such as an integrated bubble level. Level 46 may be located on upper portion 47 of base 20, for example, behind cover 100 so as to be concealed after installation or final assembly.

System 10 allows a user to select a position anywhere on drywall that is feasible to place the object desired to be held. System 10 may be used for holding tools or other objects on interior or exterior friable substrates of a residential home and is particularly useful for hanging tools or other objects from a wall or ceiling within a garage. However, system 10 may be equally usable in other applications.

The friable substrate 8 may be one of several materials used in construction, such as stucco, plaster, or gypsum based drywall sold under the trademark SHEETROCK by United States Gypsum. Drywall typically has a thickness T of about ½ inch or about ⅝ inch, but it may be obtained in other thicknesses, such as about ⅜ inch. Typically, friable substrates such as drywall are mounted to support studs, such as wood support studs, for example 2×4 studs or the like, evenly spaced apart, e.g. every 16 inches, or metal support studs, such as steel support studs. Studs are substantially more resistant to pullout than drywall because they are less friable and much less likely to break apart, but it may be harder to drive fasteners into studs.

Cover

As seen in FIGS. 1-3, system 10 may further comprise cover 100 having an upper end 106, lower end 108 and sides 109 that may conceal fasteners, holes 44 and/or leveling means 46. Cover 100 may have grooved surface 102 at an upper end 106 that may conceal or disguise scratches or other blemishes in system 100 that may appear during normal wear-and-tear of system 10. Upper end 106 of cover 100 may have a channel 110 for engaging with outwardly extending lip 42 of base 20. Lower end 108 of cover 100 may have a curved tab 112 that may engage with downturned portion 75 of secondary channel 70.

Cover 100 may further comprise an outwardly extending portion 104 proximate or integral with grooved surface 102. Outwardly extending portion 104 may have a curved surface on a forward side 103 and may further have a rib 114 or other support on a rear side 105. Rib 114 and outwardly extending portion 104 may cooperate to form channel 116 to enable cover 100 to engage with base 20, for example, by engaging upturned lip 98 within channel 116.

Endcaps

Sides 109 of cover 100 may have a plurality of holes 118, as seen in FIG. 2. Holes 118 may be spaced from each other. For example, in one embodiment, each side 109 of cover 100 may have two holes, one proximate upper end 106 and one proximate lower end 108, spaced from curved tab 112. System 10 may further comprise one or more endcaps 120 removably attachable to base 20 and/or cover 100. Endcaps 120 may have a plurality of protrusions 122 for insertion into holes 118 in cover 100. Endcaps 120 may further have secondary protrusions 124 for engagement with base 20. Secondary protrusions 124 may interface with indentation 64 in bottom 60 of bottom channel 50. Secondary protrusions 124 may further interface with protrusion 34. Protrusions 122 and secondary protrusions 124 may cooperate to hold endcaps 120 securely.

While units may be self-contained such that a user can locate system at a desired location on mounting surface, a plurality of system 10 units may be joined or abutted to extend system 10. Sides 30 of base 20 may be manufactured at a substantially equivalent angle so that a plurality of bases 20 may abut when placed side-by-side. In one embodiment, base 20 is generally rectangular such that sides 30 are generally vertical when mounted on a wall.

Alternatively, or in addition, endcaps 120 may be removable such that sides 30 of base 20 may allow for a plurality of system 10 units to interface. System 10 may have a connection 130 such as a friction fit, tongue and channel connections, tabs with mating recesses, etc. If base 20 comprises connection 130, one or both endcaps 120 may be removed to allow access to connection 130, as shown in the exploded view of FIG. 2. However, for outermost units being connected, outermost endcap 120 covering non-interfacing side 30 may not need to be removed.

Attachment Arms

System 10 may further comprise one or more outwardly-extending arms 150. As seen in FIG. 20, system 10 may additionally comprise a shelf 180, and arms 150 may be used to support shelf 180 or an object placed on top of arms 150. When installed, upper surface 152 of arms 150 may, therefore, be generally perpendicular to mounting surface 8 and/or to base 20 so that shelf 180 is generally level.

Figure 4:
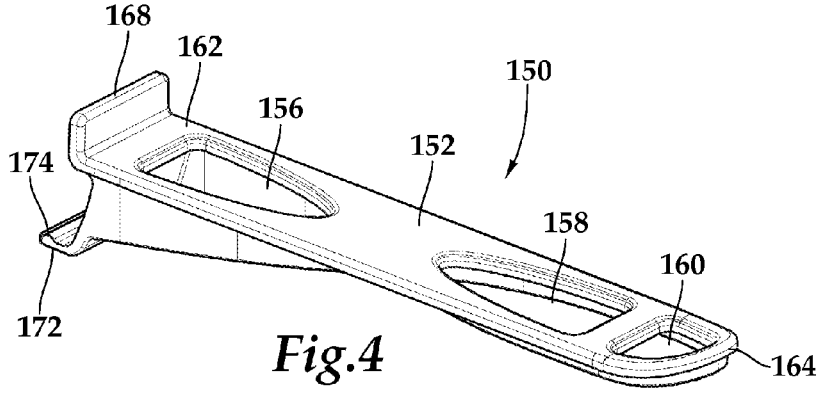
FIG. 4 is a perspective view of an attachment arm.
Figure 5:
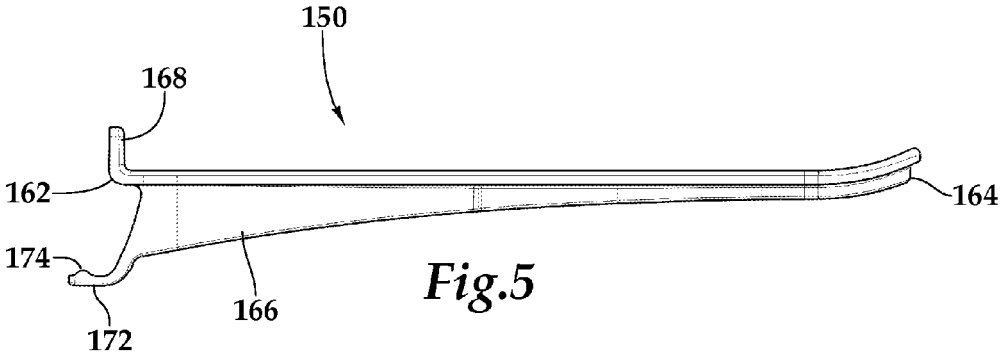
FIG. 5 is a side view of the attachment arm of FIG. 4.

Turning to FIGS. 4 and 5, arm 150 may have one or more holes 156 extending from upper surface 152 at least partially through arm 150 and, in one embodiment, completely through arm 150 to lower surface 154. Holes 156 may reduce weight of arm 150, reducing the amount of material required to make arm and, therefore, the cost to produce arm 150 without sacrificing strength and/or rigidity of arm 150. In addition, hole 156 may allow for an object to be hung from arm 150.

In one embodiment, arm 150 may have two holes 156, 158, one hole 156 extending from near a proximal end 162 of arm 150 and narrowing along a length of arm 150, the second hole 158 spaced from first hole 156 and generally a mirror-image of first hole 156. In another embodiment, arm 150 may have a third hole 160 at a distal end 164.

Distal end 164 of arms 150 may be upturned, for example, to prevent shelf 180 from moving away from base 20 or falling off arms 150. Base 20 may have additional means to hold shelf 180 such as retaining clips or clamps to compress against shelf 180 or a channel sized preferably slightly smaller than a thickness of shelf 180 to create an interference fit between shelf 180 and channel. In one embodiment, channel is formed as the space between upper surface 152 of arm and curved tab 112 on lower end 108 of cover 100.

Arm 150 may have support rib 166 on underside of arm 150. Support rib 166 may be thicker at proximal end 162, narrowing along length of arm 150 toward distal end 164.

Staying with FIGS. 4 and 5, arm 150 may further have an upturned tab 168 to rest against downturned portion 75, thereby interfacing with secondary channel 70. When arm 150 is installed, downturned portion 75 may prevent upturned tab 168, and therefore arm 150, from moving away from base 20. Arm 150 may also have a support surface 170 having a height and an angle substantially similar to height and angle of protrusion 34 or to distance between bottom channel 50 and secondary channel 70 for interfacing along generally the entire height of protrusion 34.

Arm 150 may further have a rearwardly extending tab 172 that interfaces with top 58 of bottom channel 50. Tab 172 may have a thicker portion or dimple 174 for interfacing with indentation 62 in top 58 of bottom channel 50. Upon installation of arm 150, dimple 174 may recess in indentation 62 so as to restrict or prevent distal end 164 of arm 150 from moving upwards, unhinging or disengaging arm 150.

Arm 150 may be between about 2" and about 24", preferably between about 6" and about 24", still more preferably between about 18" and about 24". In one embodiment, arm is about 20". Base 20 may support between about 1 and about 10 arms, preferably between about 3 and about 8 arms, more preferably about 6 arms.

Hooks and Bins

Figure 6:
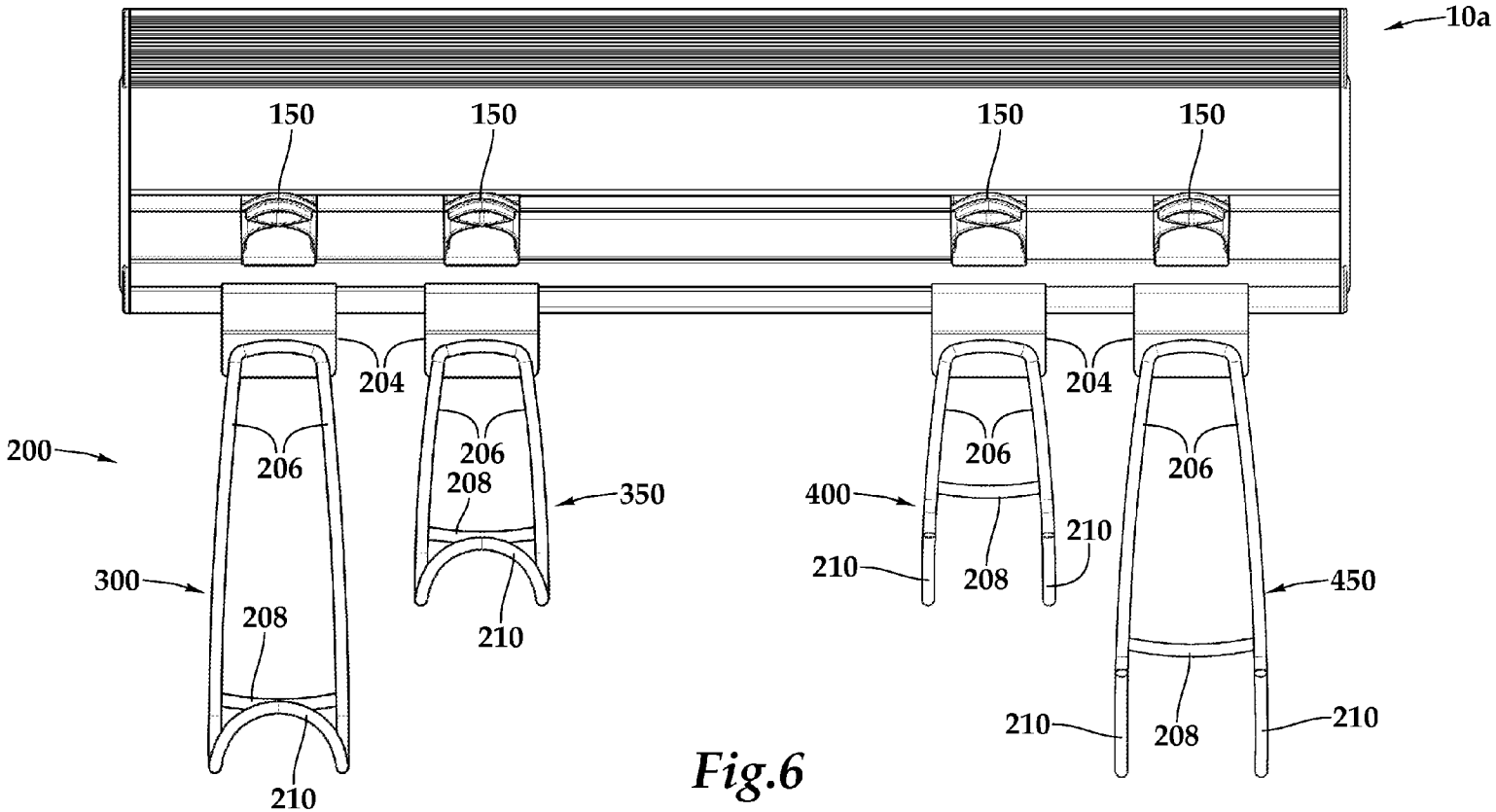
FIG. 6 is a front view of another embodiment of a storage system mountable to a friable substrate.
Figure 7:
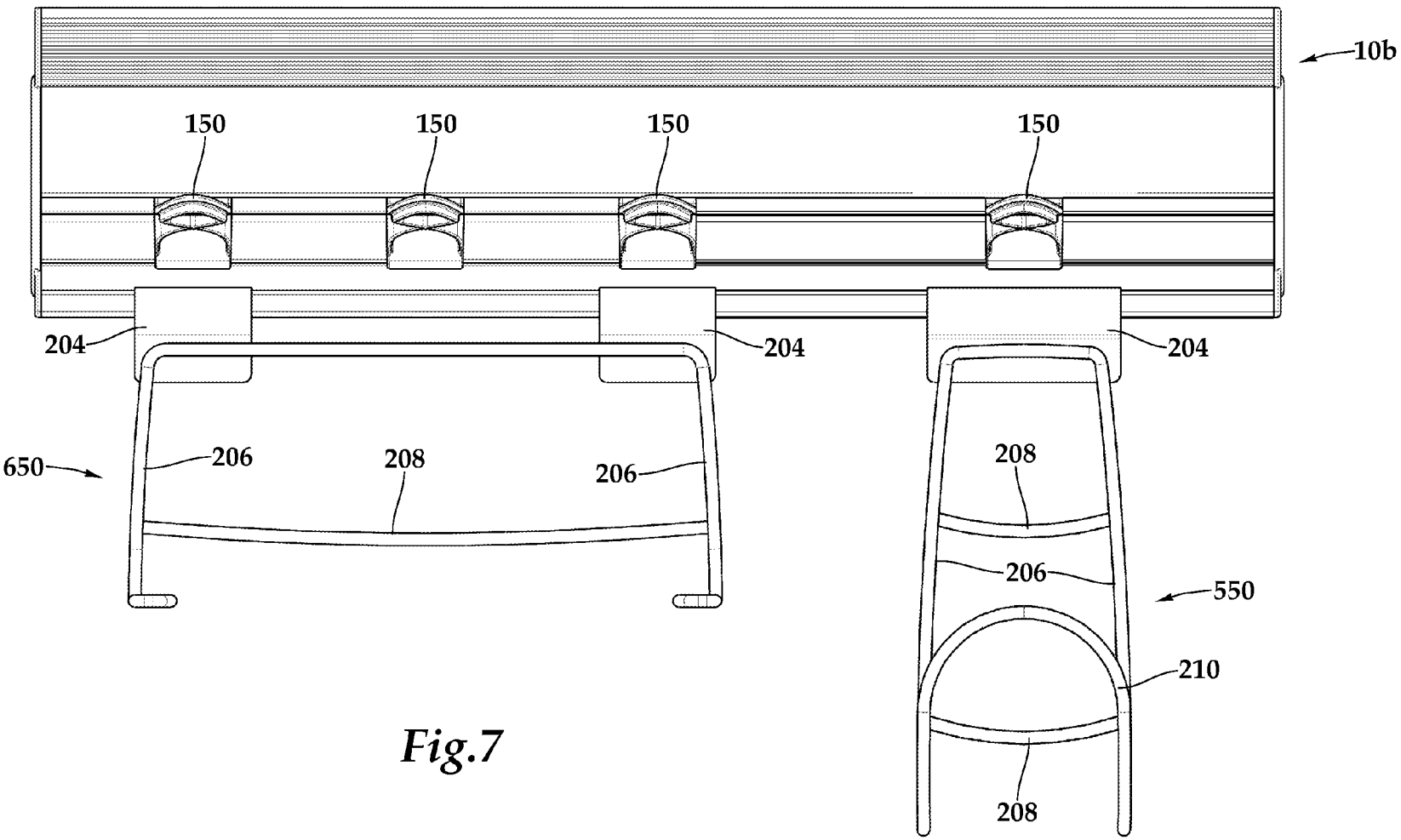
FIG. 7 is a front view of yet another embodiment of a storage system mountable to a friable substrate.
Figure 8:
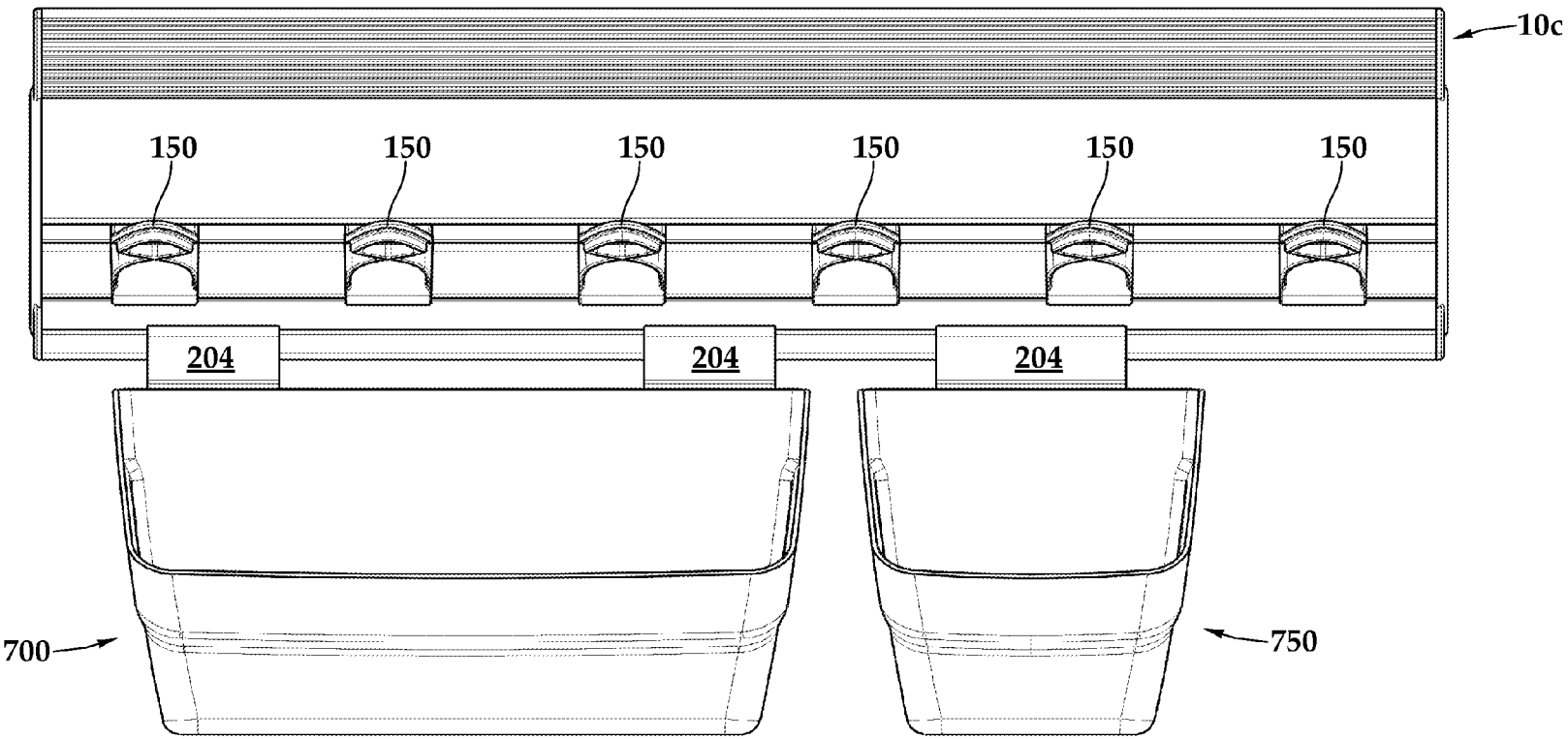
FIG. 8 is a front view of still another embodiment of a storage system mountable to a friable substrate.
Figures 9, 10, 11, 12, 13:
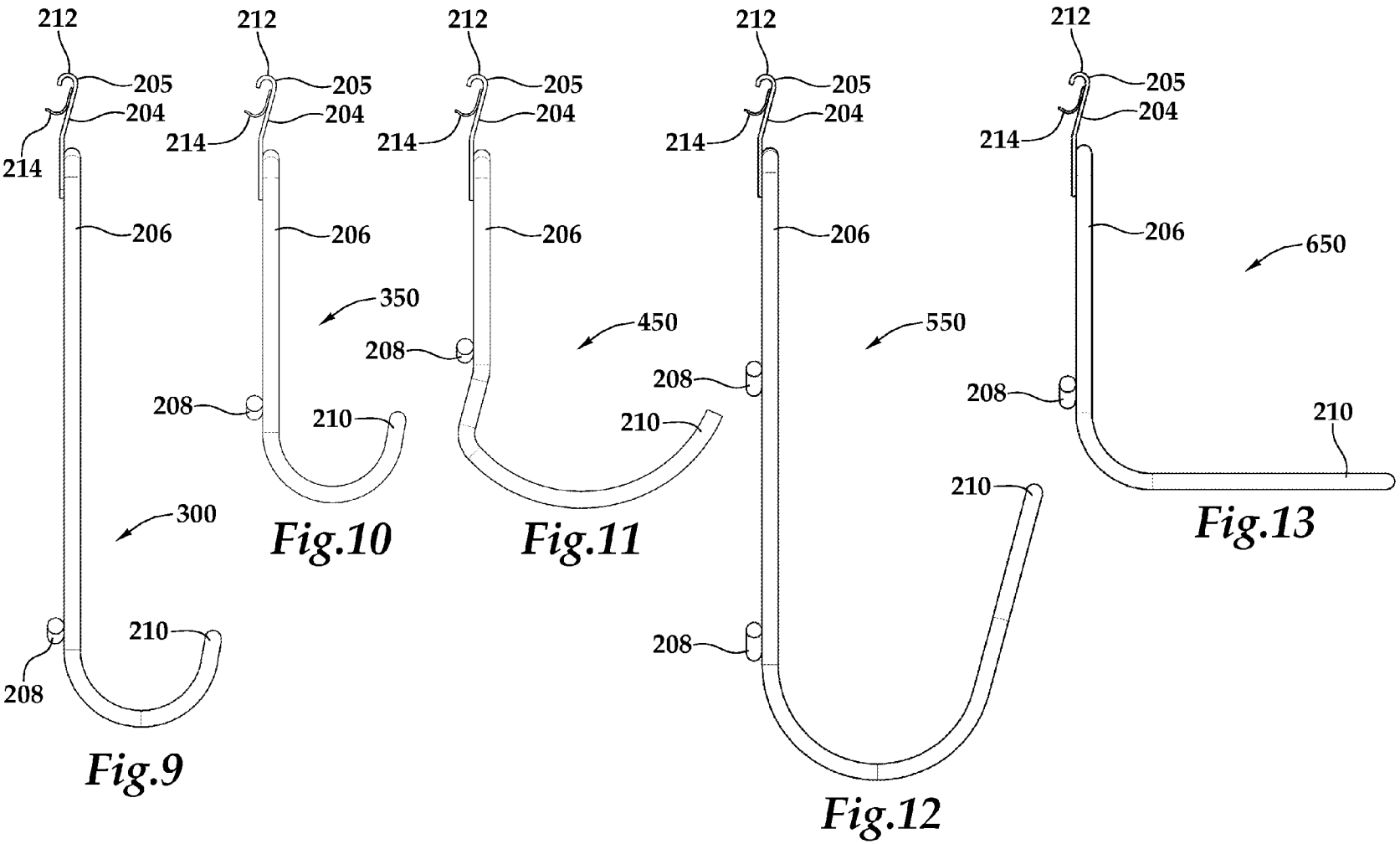
FIG. 9 is a side view of a hook shown in the embodiment of FIG. 6.
FIG. 10 is a side view of another hook shown in the embodiment of FIG. 6.
FIG. 11 is a side view of yet another hook shown in the embodiment of FIG. 6.
FIG. 12 is a side view of a hook shown in the embodiment of FIG. 7.
FIG. 13 is a side view of another hook shown in the embodiment of FIG. 7.

As seen in the embodiments of FIGS. 6-8, system 10*a*, 10*b*, 10*c* may be designed to support one or more of a variety of attachments, such as hooks 200 or receptacles or bins 202 spaced along a length of base 20. Hooks 200 and bins 202 may come in a variety of configurations to perform a variety of functions. For example, hook 200 may be a long or short straight-sided hook 300, 350, a long or short deep straight-sided hook 400, 450, a straight or curved-sided single hook 500, 550 for use, for example, in holding a hose, a straight-sided curved hook 600 or a paper towel holder 650. Bins 202 may further comprise wide 700 and narrow 750 bins.

Each hook 200 may comprise at least one mounting plate 204 operatively connected to one or more legs 206, as shown in FIGS. 10-13. Leg 206 may extend generally downward from mounting plate 204 so that, when installed, leg 206 may rest on mounting surface 8 or may be spaced a small predetermined distance from mounting surface 8. In this way, loading on system 10 and fasteners may have a larger shear component than a bending component, thereby increasing the holding strength of system 10. As can be seen in FIGS. 15-18, if leg 206 in downward region is spaced from mounting surface 8, leg 206 may be formed so as to project toward mounting surface 8 to create a point of contact before leg changes direction to project away from mounting surface 8. If hook 200 has more than one leg 206, hook 200 may further comprise at least one brace 208 between legs 206 to increase rigidity and to inhibit bending or legs 206 may be joined at a forward end to form a continuous structure extending down from mounting plate 204, along legs 206 and back to mounting plate 204.

Legs 206 may have upturned ends 210 to prevent objects from sliding off hook 206 or from being accidentally dislodged from hook 206. Leg 206 may also be coated with a rubberized or plasticized material to increase friction between leg 206 and object, further inhibiting sliding of object. Upturned end 210 may extend upwards to a position substantially level with brace 208.

Figure 16:
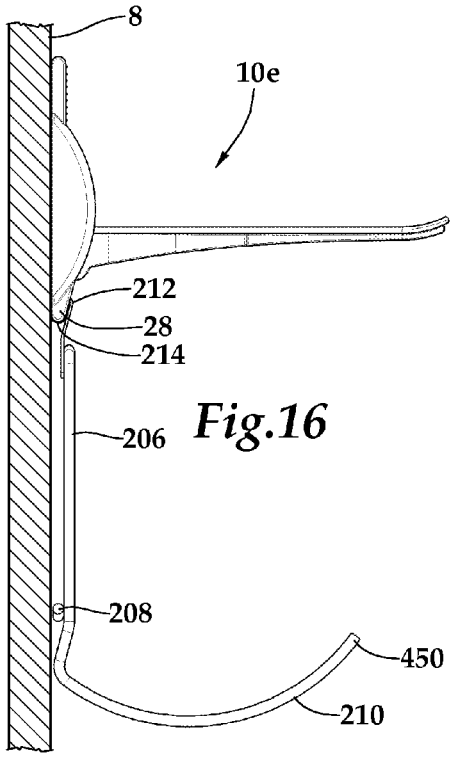
FIG. 16 is a side view of another hook installed in the storage system.
Figure 17:
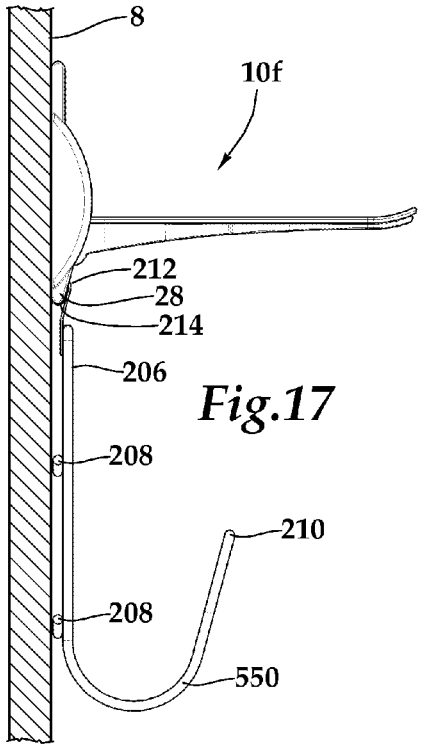
FIG. 17 is a side view of yet another hook installed in the storage system.
Figure 18:
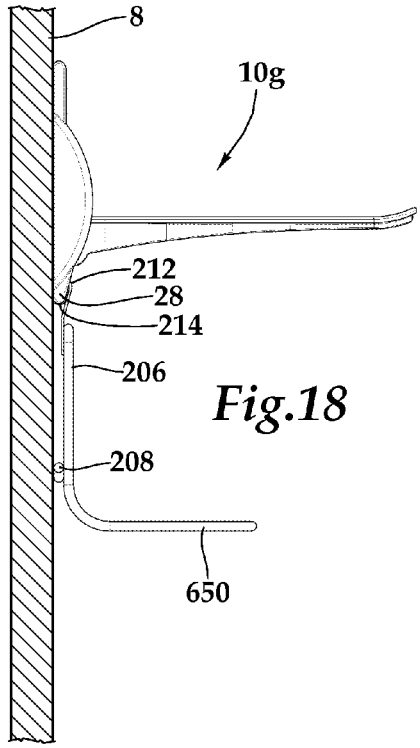
FIG. 18 is a side view of still another hook installed in the storage system.
Figure 19:
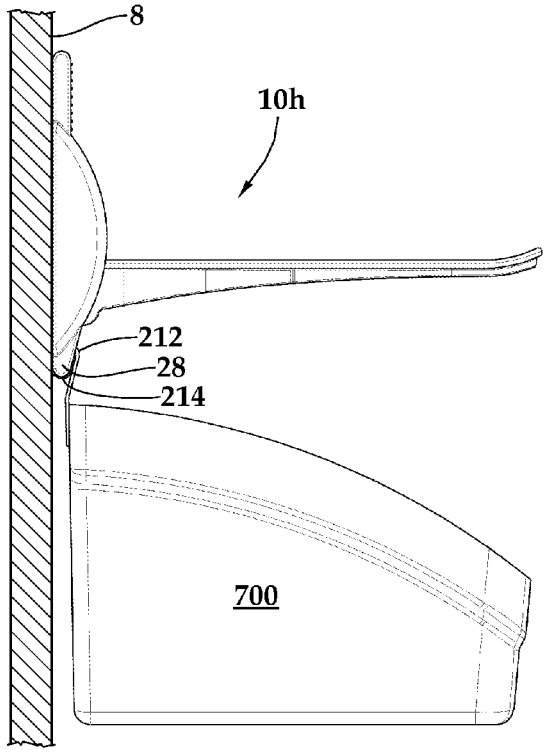
FIG. 19 is a side view of a bin installed in the storage system.

Legs 206 may extend outward in varying degrees to allow system 10 to store a variety of products. For example, as seen in FIG. 16, hooks 450 may extend substantially the same distance from mounting surface 8 as shelf 180 to hold wider objects, such as a hose. As shown in FIG. 6, hooks 400, 450 may also be spaced apart to allow passage of an object between legs, such as a broom or shovel handle, while allowing the broom head or shovel to rest on legs.

Hooks 200 may also come in varying lengths to store objects at different heights, as can be seen through comparison of hooks 300, 350 and 400, 450 in FIG. 6.

Moreover, hooks 200 may be designed for specialized tasks. Hook 650 may have two legs 206 spaced a substantial distance apart, wherein the legs 206 are directed inwardly so as to hold a roll of paper towels.

As shown in FIGS. 15-19, upper end 205 of mounting plate 204 may have a generally downward facing hook 212 to operatively connect hook 200 to base 20. Generally downward facing hook 212 may be placed over upper part 54 of forward side 52 of bottom channel 50. Generally downward facing hook 212 may vary in length, but preferably may extend substantially the width of mounting plate 204. Mounting plate 204 may additionally have a generally upward facing hook 214 to secure hook 200 to base 20. Generally upward facing hook 214 may be placed under bottom 28 of base 20. Generally downward facing hook 212 may also vary in length. Generally downward facing hook 212 may be between about ⅕ and about as wide as mounting plate 204, preferably between about ¼ and about ½ as wide as mounting plate 204, still more preferably about ⅓ as wide as mounting plate 204. In addition, generally downward facing hook 212 may be centered on mounting plate 204. By placing generally downward facing hook 212 over bottom channel 50 and a generally upward facing hook 214 under base 20, hook 200 may be effectively locked into position, restraining hook 200 from movement other than laterally along bottom channel 50.

Figure 14:
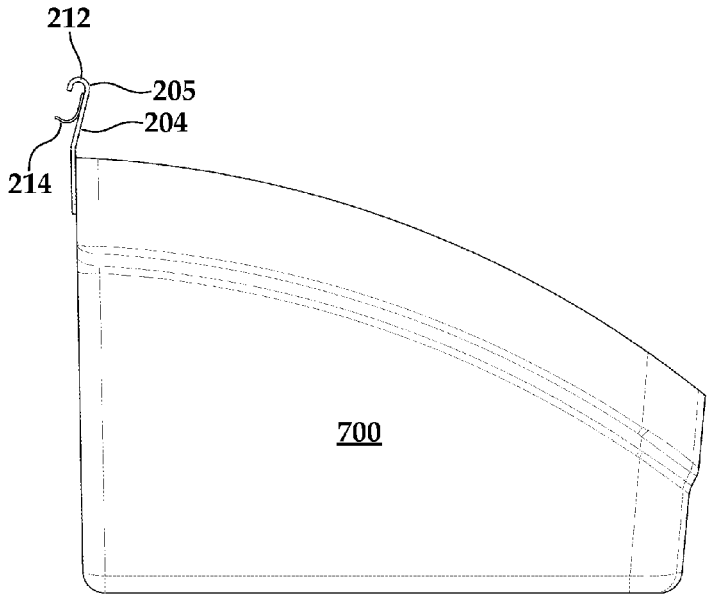
FIG. 14 is a side view of the bins shown in the embodiment of FIG. 8.
Figure 15:
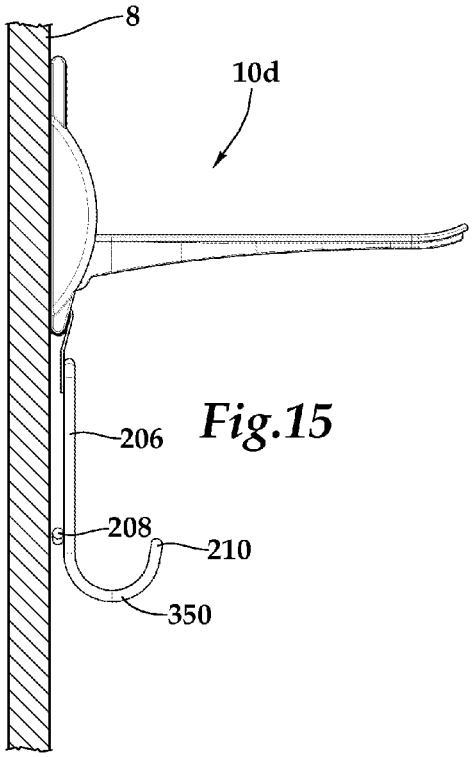
FIG. 15 is a side view of a hook installed in the storage system.

In addition to hooks 200, system 10 may support one or more bins 202. As can be seen in FIG. 14, bins 202 may be secured to system in much the same way as hooks 200. System 10 may be modular in that a user may select one or more of the various hooks 200 and/or bins 202 to customize system 10 to his or her desired use.

Hooks 200 and/or bins 202 may also comprise a plurality of generally downward facing hooks and generally upward facing hooks, spaced from each other along a length of mounting plate 204 or on a plurality of mounting plates 204, respectively. Plurality of generally upward and downward facing hooks may be useful for added stability in wider hooks 200 such as paper towel holder 650 or in wider bins 202.

Drywall Fastener

In one embodiment, shown in FIGS. 21-25, self-drilling drywall fastener 810 includes a high-threaded proximal portion 818 having threading 819 with a crest diameter and a high thread height for engaging drywall, and threaded drilling portion 822 longer than a thickness of drywall and threading 823 with a crest diameter substantially smaller than the crest diameter of proximal portion 818 and a thread height substantially smaller than the thread height of proximal portion 818.

The crest diameter of threading 819 of proximal portion 818 may be about twice the root diameter of threading 823. In one embodiment, the crest diameter of threading 819 may be between about ¼ inch and about ¾ inch, for example about ½ inch, the root diameter at proximal portion 818 may be between about ⅛ inch and about ⅜ inch, and the thread height of threading 823 may be between about ⅛ inch and about ⅝ inch, for example about ¼ inch. The high-threaded proximal portion 818 may be slightly longer than drywall thickness so that high threading 819 is able to engage the paper on an inner drywall surface to add further to the pullout resistance and load capacity of system 10 as well as to accommodate the seating of the head 814 on the front surface 22 around the hole 44.

In one embodiment, drywall gripping threading 819 may be one continuous generally helical thread and the root of proximal portion 818 expands tapers from drilling portion 822 toward proximal end so that drywall fastener 810 has enough strength to be driven into wood.

The screw-like drilling portion 822 with a length longer than drywall thickness allows drywall fastener 810 to bore a hole entirely through the drywall before high threading 819 on proximal portion 818 begins to engage the drywall. The screw-like smaller threading 823 of drilling portion 822 also allows drywall fastener 810 to be able to grip and drill into a stud if a user encounters a stud while installing base 20 because the substantially smaller thread height and crest diameter of drilling portion 822 may be driven into a stud without excessive torque. In one embodiment, the crest diameter of threading 823 of drilling portion 822 is between about 1/16 inch and about ¼ inch, e.g., about ⅛ inch, and the thread height of threading 823 is between about 0.02 inch and about 0.07 inch, e.g., about 0.035 inch.

Threading 823 may include a generally helical thread that may continue as thread 819 on proximal portion 818 so that there may be a continuous thread between drilling portion 822 and proximal portion 818. In one embodiment, drilling portion 822 may include two generally helical threads arranged in a double helix to provide added support around drilling portion 822, to provide faster engagement of drywall fastener 810 with a stud, and to provide balanced driving into stud. The second thread of the double helix may be present for only a portion of drilling portion 822 proximate drilling end 831, or it may continue substantially through all of drilling portion 822 to provide improved grip with a stud.

Drywall fastener 810 may include a drill tip 816 at drilling end 831. In one embodiment, drill tip 816 is generally conical in shape and coaxial with axis 6 so that drill tip 816 comes to point at axis 6 to guide and quickly engage outer drywall surface and the surface of a stud. In one embodiment, drilling portion 822 may include at least one wing 854, and as shown, a pair of wings 854, that protrudes radially outwardly from drilling portion 822 for reaming out drywall to form a hole having the desired size. Wings 854 are designed to break away when they hit a stud so that wings 854 ream out drywall and not a stud.

While the foregoing written description of the invention enables one of ordinary skill to make and use what is considered presently to be the best mode thereof, those of ordinary skill will understand and appreciate the existence of variations, combinations, and equivalents of the specific exemplary embodiment and method herein. The invention should therefore not be limited by the above described embodiment and method, but by all embodiments and methods within the scope and spirit of the invention as claimed.

What is claimed is:

1. A storage system mountable to a substrate comprising:

a base having a front surface and a rear surface, said base comprising a bottom channel, a top channel spaced from said bottom channel and a protrusion therebetween, and a plurality of holes extending from said front surface to said rear surface, said holes configured to accept substrate-mounting fasteners;

at least one arm having an upper tab and a rearwardly extending tab, wherein said upper tab is configured to engage said top channel and said rearwardly extending tab is configured to engage a bottom surface of said protrusion;

wherein said rearwardly extending tab extends rearward further than said upper tab;

wherein a bottom of said protrusion extends away from said front surface and comprises a top of said bottom channel; and wherein said bottom channel is shaped differently than said top channel.

2. A storage system according to claim 1, wherein said top channel has a downturned portion, said downturned portion has a rearward facing surface and said upper tab operatively engages said rearward facing surface.

3. A storage system according to claim 1, wherein said bottom surface comprises an indentation and said rearwardly extending tab comprises a dimple that operatively engages said indentation.

4. A storage system according to claim 1, wherein said upper tab has a height substantially similar to a height of said top channel.

5. A storage system according to claim 1, further comprising a level on said base.

6. A storage system according to claim 5, wherein said system further comprises a cover and said cover conceals said level when operatively coupled to said base.

7. A storage system according to claim 1, further comprising at least one hook or at least one bin operatively coupled to said bottom channel.

8. A storage system according to claim 7, wherein said at least one hook or at least one bin has at least one mounting plate, said mounting plate having at least one generally downward facing hook and at least one generally upward facing hook.

9. A storage system according to claim 8, wherein said generally downward facing hook operatively connects to said bottom channel and said generally upward facing hook operatively connects to a bottom of said base.

10. A storage system mountable to a friable substrate comprising:

a base having a plurality of holes for accepting a plurality of drywall fasteners, a lower channel, a protrusion extending outward from a rear surface of said base and proximate said lower channel, and a secondary channel proximate said protrusion, wherein said lower channel is shaped differently than said secondary channel;

a plurality of self-drilling drywall fasteners having a crest diameter of at least about ¼ inch;

a plurality of arms operatively engaged with said base at said lower channel, said protrusion and said secondary channel;

a shelf operatively connected to said plurality of arms and said base; and at least one hook or bin operatively engaged with said base at said lower channel;

wherein a bottom of said protrusion comprises a top of said lower channel.

11. A storage system according to claim 10, further comprising:

a connection for attaching said base to a second base.

12. A storage system according to claim 11, further comprising:

at least one end cap for concealing said connection.

13. A storage system according to claim 10, wherein said protrusion is angled with respect to said base and said plurality of arms have a rear surface having a substantially similar angle for operative connection with said protrusion.

14. A storage system according to claim 13, wherein said protrusion has a bottom surface comprising an indentation and further wherein at least one of said plurality of arms has a dimple for operatively engaging said indentation.

15. A storage system according to claim 10, wherein said at least one hook or bin has a generally downward facing hook and a generally upward facing hook.

16. A storage system according to claim 15, wherein said base has a bottom, said lower channel has a forward side having an upper part, said generally downward facing hook operatively engages said upper part and said generally upward facing hook operatively engages said bottom.

17. A storage system according to claim 1, wherein said bottom channel is adapted to receive a second arm.

18. A storage system comprising:

a base having a front surface, said base comprising a bottom channel, a top channel spaced from said bottom channel and protrusion therebetween;

at least one arm having an upper tab and a rearwardly extending tab, wherein said upper tab is configured to engage said top channel and said rearwardly extending tab is configured to engage a bottom surface of said protrusion;

wherein a bottom of said protrusion extends away from said front surface and comprises a top of said bottom channel;

wherein said bottom channel is shaped differently than said top channel; and at least one hook or at least one bin operatively coupled to said bottom channel.

19. A storage system according to claim 18, wherein said at least one hook or at least one bin has at least one mounting plate, said mounting plate having at least one generally downward facing hook and at least one generally upward facing hook.

* * * * *